United States Patent [19]

Foss

[11] 4,394,635

[45] Jul. 19, 1983

[54] METHOD FOR DETERMINING DISSOLVED GAS CONCENTRATIONS IN DIELECTRIC COOLANTS

[75] Inventor: Stephen D. Foss, Pittsfield, Mass.

[73] Assignee: General Electric Company, New York, N.Y.

[21] Appl. No.: 254,902

[22] Filed: Apr. 16, 1981

[51] Int. Cl.[3] ..... H01F 27/08

[52] U.S. Cl. ..... 336/55; 73/19; 174/15 R; 174/16 R; 336/57; 336/61; 336/62; 374/152

[58] Field of Search ..... 174/15 R, 16 R, 14 R, 174/12 R; 336/55, 57, 61, 62; 73/373, 328, 19; 62/125

[56] References Cited

U.S. PATENT DOCUMENTS

| | | | |
|---|---|---|---|
| 2,784,565 | 3/1957 | Stalkup | 62/125 |
| 3,028,566 | 4/1962 | Camilli | 174/15 R |
| 3,874,323 | 4/1975 | Rottig | 62/125 |

*Primary Examiner*—A. T. Grimley
*Assistant Examiner*—Susan Steward
*Attorney, Agent, or Firm*—Robert A. Cahill

[57] ABSTRACT

The quantity of $SF_6$ gas dissolved in a halogenated dielectric coolant used in transformers can be determined by heating a sample quantity of the sample gas coolant to the point of cavitation and comparing the temperature and pressure at which cavitation first appears to a graphic representation of the relationship between concentration, pressure and temperature to obtain the gas concentration from the observed temperature point.

12 Claims, 4 Drawing Figures

METHOD FOR DETERMINING DISSOLVED GAS CONCENTRATIONS IN DIELECTRIC COOLANTS

BACKGROUND OF THE INVENTION

Halogenated hydrocarbons such as Freon, designated R113 and manufactured by the DuPont Chemical Company, are used in high-power rated transformers for cooling the transformer windings. A gas insulated transformer contains a high-pressure transformer tank filled with sulfur hexafluoride ($SF_6$) or carbon hexafluoride ($C_2F_6$) to provide electrical insulation to the transformer windings. A quantity of Freon coolant is piped through the transformer windings in a closed piping system that connects with a heat exchanger and a pump to return the cooled Freon back to the windings. The presence of $SF_6$ gas in the Freon line could cause cavitation and interfere with the transport coolant properties of the Freon coolant.

A vaporization cooled transformer, such as described within U.S. patent application Ser. No. 843,676, filed Oct. 19, 1977, utilizes a quantity of Freon coolant to cool and insulate transformer windings at the operating temperature of the transformer. A quantity of $SF_6$ gas can be employed in the space above the Freon coolant to provide dielectric insulation to the windings during transformer start-up when the Freon is totally in its liquid phase. Determining the quantity of $SF_6$ that becomes dissolved within the Freon coolant provides an indication as to the severity of leaks that may develop during transformer operation.

The purpose of this invention is to provide a simple and efficient means for monitoring the concentration of $SF_6$ in Freon during transformer operation without having to disconnect the transformer from operation during the determination process.

SUMMARY OF THE INVENTION

The invention comprises determining the concentration of $SF_6$ in Freon by observing the temperature and pressure at which the $SF_6$-Freon begins to cavitate. Comparing the temperature of cavitation to a graphic representation of gas concentration as a function of pressure and temperature allows the gas concentration to be accurately determined. The invention also provides an indication of an air leak in a Freon cooled transformer without $SF_6$ insulating gas.

DESCRIPTION OF THE PREFERRED EMBODIMENT

Figure 1:
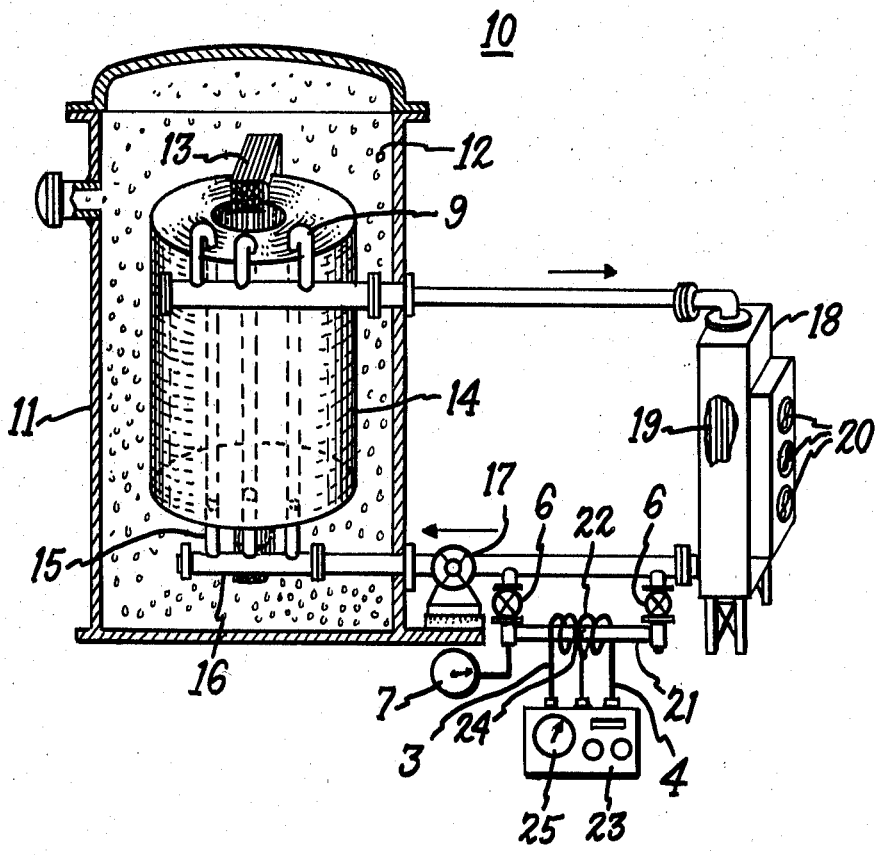
FIG. 1 is a front view in partial section of a gas transformer utilizing gas concentration apparatus according to the instant invention.

A gas transformer 10 shown in FIG. 1, consists of a transformer tank 11 containing a quantity of $SF_6$ gas 12 under several atmospheres pressure. Also within tank 11 is a transformer core 13 surrounded by a plurality of transformer windings 14. A plurality of ducts 9 extend within windings 14 and contain a plurality of tubes 15 for cooling windings 14. Tubes 15 are connected to a manifold 16 through which Freon is transported to heat exchanger 18 containing cooling tubes 19 and fan 20 and returned to tubes 15 by means of pump 17. Heat generated within windings 14 is carried by the Freon coolant within tubes 15 out to heat exchanger 18 where the heat is dissipated to the atmosphere. Any leaks occurring within tubes 15 or manifold 16 can cause $SF_6$ gas to mix with the Freon coolant. If sufficient quantity of $SF_6$ becomes dissolved in the Freon, cavitation can occur at a particular temperature and pressure interfering with the transport of Freon through pump 17. The direction of flow of Freon through the system is indicated by arrows. In order to determine the concentration of $SF_6$ in Freon at any time, a sight glass 21 is connected with manifold line 16 by a pair of valves 6 and a heater 22 is employed to heat the Freon contained within sight glass 21. Heater 22 can consist of several turns of a fine diameter resistance wire which is electrically supplied by means of control 23 containing a power supply (not shown). A thermocouple 24 is attached to the wall of sight glass 21 and a visual indication of the temperature existing within sight glass 21 at any time is provided at indicator 25. Thermocouple 24 is connected with control 23 by means of lead 8 and heater 22 is electrically connected with control 23 by means of leads 3 and 4. To determine the temperature of cavitation for Freon within manifold pipe 16 the temperature of heater 22 is gradually increased and the observed temperature at indicator 25 is recorded. Cavitation is observed by noting the formation of tiny bubbles within sight glass 21 indicating that the Freon has become saturated for the concentration of gas present within manifold line 16. Since pressure also effects the concentration of $SF_6$ in Freon, gauge 7 is employed to determine the pressure when concentration determinations are made.

Figure 2:
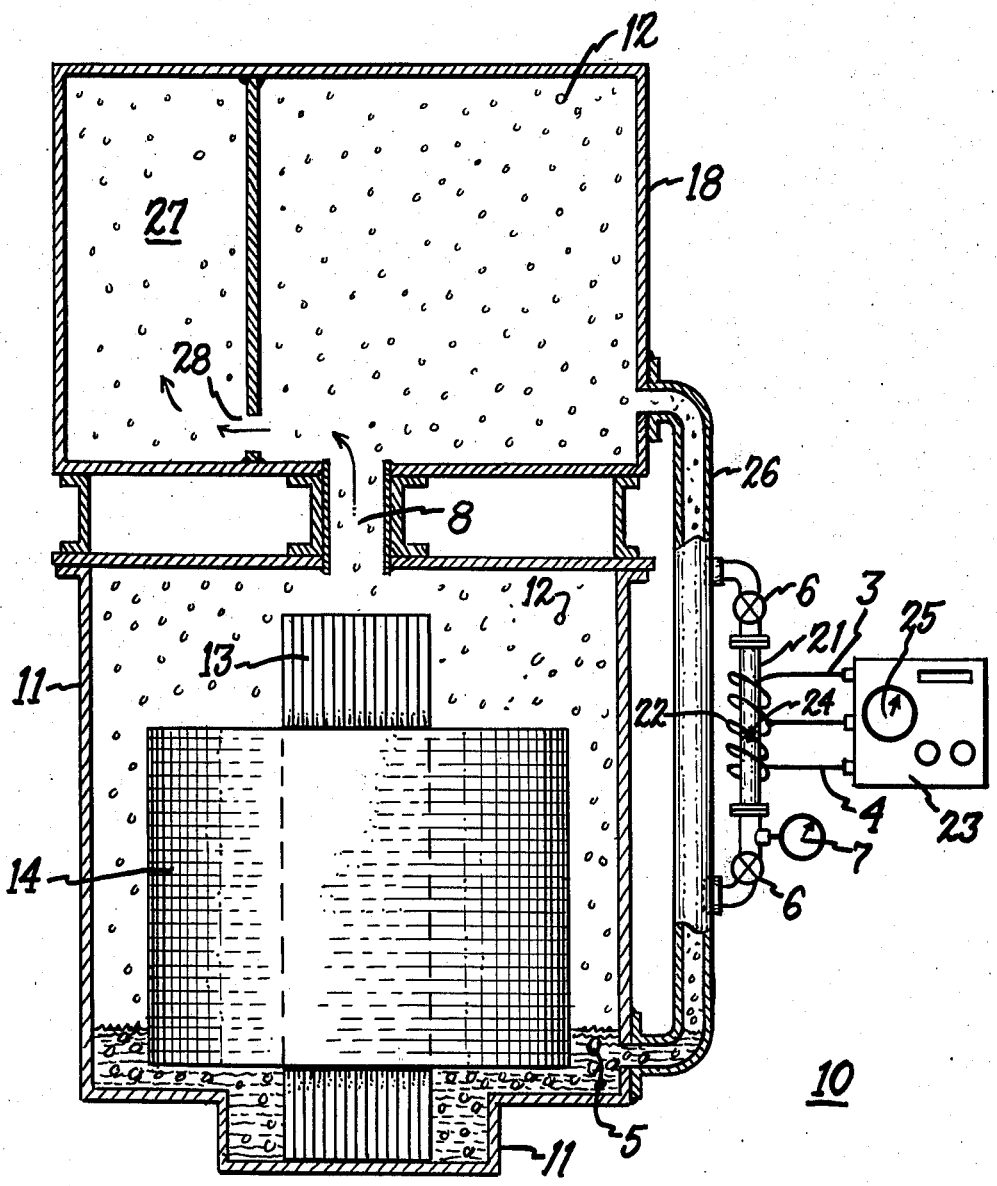
FIG. 2 is a front view in partial section of a vaporization-cooled transformer utilizing the gas concentration apparatus of the instant invention.

FIG. 2 shows a vaporization-cooled transformer 10 consisting of a transformer tank 11 containing a quantity of $SF_6$ gas 12 under pressure. A transformer core 13 and surrounding winding 14 are placed in contact with a quantity of Freon 5 for both insulating and cooling winding unit 14 during operation. Upon first start-up of transformer 10, $SF_6$ gas 12 insures that winding 14 is electrically insulated to prevent short circuit effects before Freon 5 can become vaporized. During transformer operation Freon 5 vaporizes and enters heat exchanger 18 through channel 8 for condensing and returning back to tank 11 by means of return line 26. When Freon 5 becomes vaporized $SF_6$ gas 12 becomes separated in expansion tank 27 which connects with heat exchanger 18 by means of passage 28. The quantity of $SF_6$ gas dissolved within Freon 5 provides an indication of the total quantity of $SF_6$ gas in transformer tank 11 upon initial start-up. When transformer 10 is first energized a quantity of Freon 5 within return line 26 is directed within sight glass 21 by means of connecting valves 6 and is heated within sight glass 21 by means of heater 22. The temperature at thermocouple 24 is noted at indicator 25 on control 23 as described for the embodiment depicted earlier in FIG. 1 and pressure readings are obtained by means of gauge 7. The temperature and pressure at which cavitation of the Freon 5 occurs is determined from the graphical representation shown in FIG. 3. The temperature at which cavitation occurs is plotted as a function of concentration of $SF_6$ in Freon coolant and it is noted that cavitation occurs when the temperature at sight glass 21 exceeds the equilibrium temperature for saturation of $SF_6$ in Freon for a given value of pressure. Readings at sight glass 21 should be taken shortly after the transformer start-up since most of the $SF_6$ gas becomes separated within expansion tank 27 when transformer 10 becomes fully operational and Freon 5 reaches steady state operating temperature.

Figure 3:
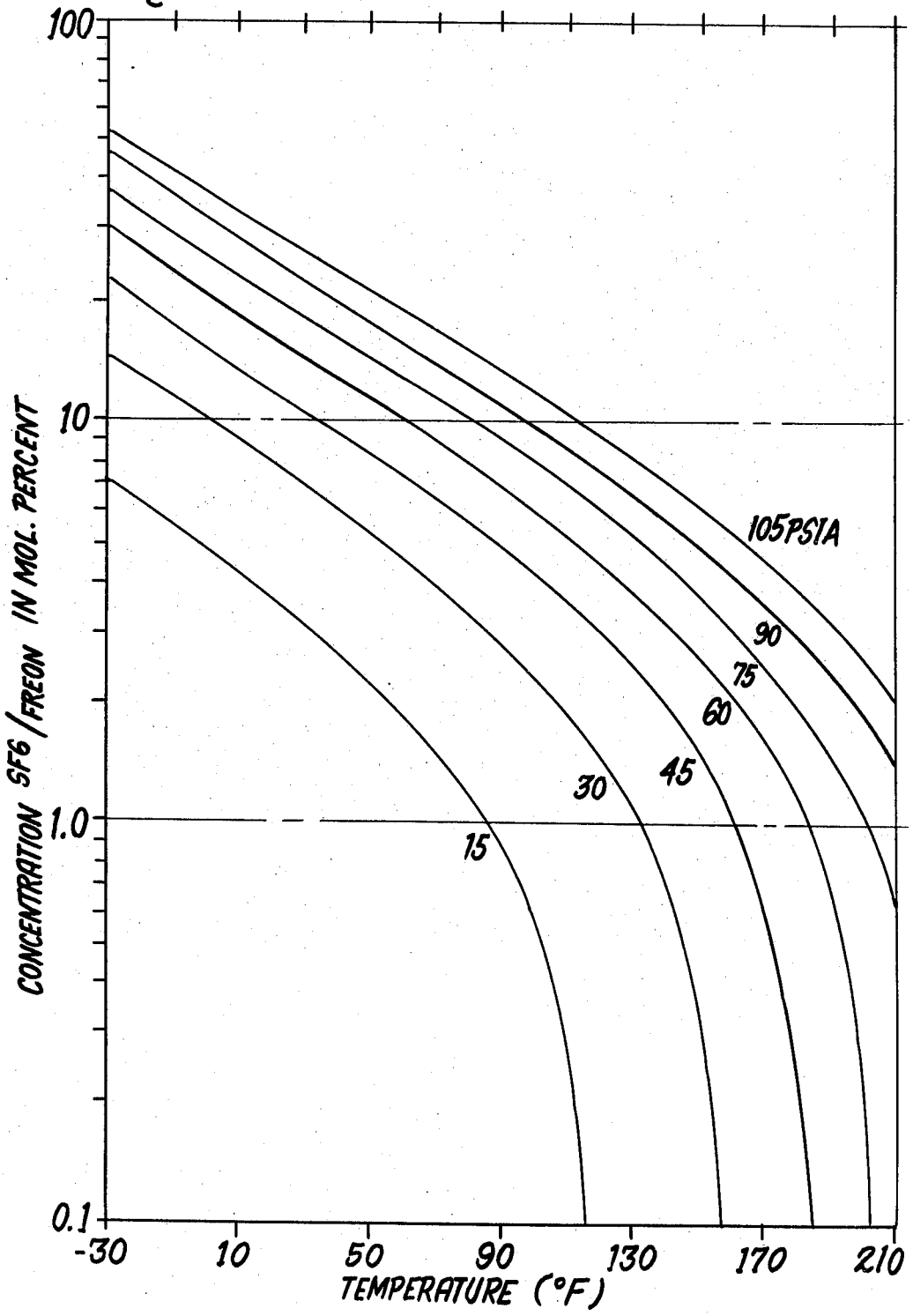
FIG. 3 is a graphic representation of the relationship between concentration of $SF_6$ in Freon as a function of both temperature and pressure.

To determine the concentration of $SF_6$ in Freon, from the data plotted in FIG. 3, find the measured temperature on the abscissa and note the concentration on the ordinate that corresponds to the measured pressure. For a measured temperature of 130° F., and a measured pressure of 30 P.S.I.A., the concentration would be 1.10 percent.

An alternate method for determining the concentration of $SF_6$ in Freon for both transformers shown in FIGS. 1 and 2 would be to obtain a sample of Freon from tank 11 and subjecting the sample to a separate heat, pressure, and temperature recording arrangement remote from transformer 10. This method is not as efficient and convenient as the on-line monitoring systems described within FIGS. 1 and 2. In some instances, for example, $SF_6$, 12, depicted in FIG. 2, does not become completely separated within expansion tank 27 but remains dissolved within Freon 5 at high concentrations and at low operating temperatures. A rapid increase in temperature, caused by a line current surge, could cause rapid cavitation to occur within Freon 5 resulting in the formation of bubbles within winding 14 causing electrical problems to occur within winding 14. A continuous monitor of $SF_6$ concentration, within the Freon, would accurately and reliably predict such situations.

Figure 4:
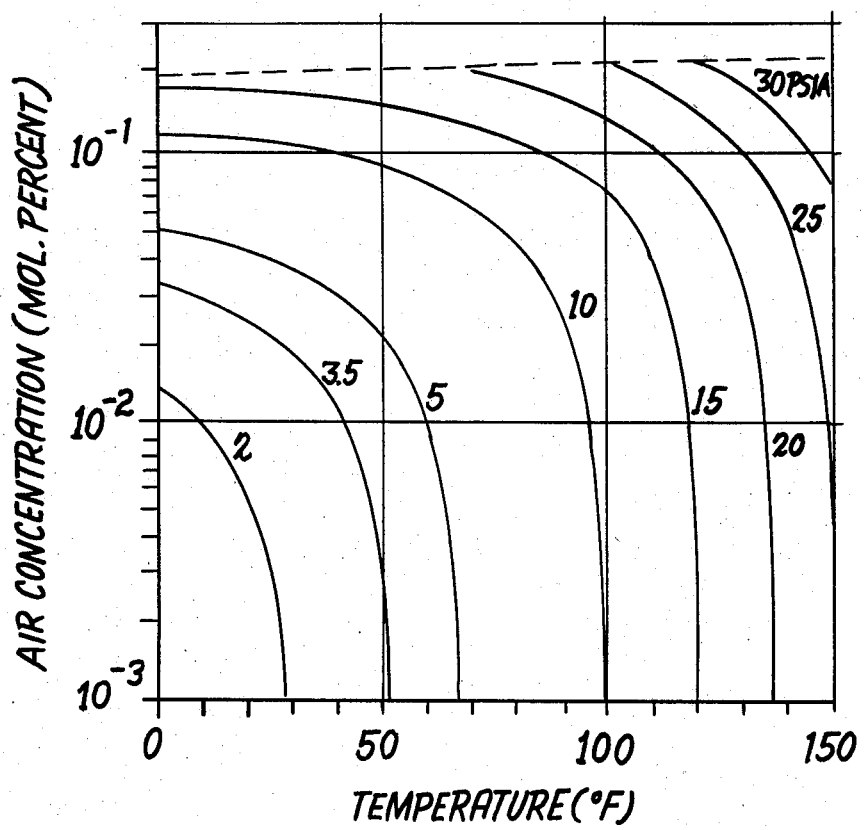
FIG. 4 is a graphic representation of the relationship between concentration of air in Freon as a function of both temperature and pressure.

The method of the invention can be used with the vaporization-cooled transformer shown in FIG. 2 to determine the presence of air leaks when no insulating noncondensable gas is employed and to determine the leak rate from the data given in FIG. 4. The temperature within sight glass 21 is increased until cavitation is noted. Temperature and pressure readings are taken from gauges 25, 7 and the air concentration in Freon is taken from FIG. 4 in the same manner as indicated earlier for determining $SF_6$ in Freon. By monitoring the concentration of air in Freon over a period of time the leak rate can also be determined. When a chlorinated fluorocarbon such as trichlorotrifluoroethane is employed as the Freon coolant, sight glass 21 can also be used to observe any clouding of the coolant which occurs when water is present.

What is claimed as new and which it is desired to secure by Letters Patent of the United States is:

1. A power transformer comprising, in combination:
- a transformer tank containing a non-condensable gas and a liquid;
- a transformer core and winding disposed within said tank in thermally coupled relation with the liquid;
- a sight glass in fluid flow relation with the interior of said tank for containing an observable sample of the liquid;
- heater means in thermal relation with said sight glass for heating the liquid sample to cavitation;
- pressure indicating means coupled with said tank for determining the pressure of the liquid sample; and
- temperature indicating means proximate said sight glass for determining the temperature of the liquid sample;
- whereby the concentration of the non-condensable gas dissolved in the liquid can be determined by noting the temperature and pressure of the liquid sample at the onset of cavitation.

2. A gas-insulated transformer comprising:
- a transformer tank containing a noncondensable gas for use as a dielectric insulating medium;
- a plurality of transformer windings arranged around a transformer core within said tank;
- a plurality of tubes extending through said windings and containing a liquid coolant for cooling said winding during transformer operation;
- piping means connecting with said coolant tubes and with a heat exchanger for carrying said coolant to said heat exchanger and removing heat from said coolant;
- a sight glass connected with said piping means for observing a sample of said coolant within said piping means;
- a pressure indicating means connected with said piping means for determining said coolant pressure;
- heater means in thermal contact with said sight glass for heating said coolant to cavitation within said sight glass; and
- temperature indicating means thermally proximate said sight glass for indicating the temperature of coolant within said sight glass.

3. The transformer of claim 2 wherein the coolant comprises a halogenated hydrocarbon.

4. The transformer of claim 2 wherein said noncondensable gas comprises sulfur or carbon hexafluoride.

5. The transformer of claim 2 wherein said heater means comprises a plurality of turns of resistance wire around said sight glass.

6. The transformer of claim 2 wherein said temperature indicating means comprises a thermocouple.

7. A vaporization cooled transformer comprising:
- a transformer tank containing a condensable liquid coolant;
- a transformer core and winding within said tank for contact with said coolant;
- a heat exchanger connected with said tank for receiving said coolant in vaporized form and returning said coolant in condensed form;
- an expansion tank connected with said transformer for isolating said noncondensable gas from said coolant during transformer operation;
- a sight glass connected with said tank for providing visual access to said coolant;
- heater means in thermal relation with said sight glass for heating said coolant to cavitation;
- pressure indicating means connected with said transformer for determining said coolant pressure; and
- temperature indicating means thermally proximate said sight glass for determining the temperature of said coolant.

8. The transformer of claim 7 wherein said coolant comprises a halogenated hydrocarbon.

9. The transformer of claim 8 wherein the halogenated hydrocarbon comprises a chlorinated fluorocarbon.

10. The transformer of claim 9 wherein the chlorinated fluorocarbon comprises trichlorotrifluoroethane.

11. The transformer of claim 7 further including a noncondensable gas.

12. The transformer of claim 7 wherein the noncondensable gas is selected from the group consisting of carbon hexafluoride, sulfur hexafluoride and air.

* * * * *